United States Patent [19]

Casad et al.

[11] 4,233,923

[45] Nov. 18, 1980

[54] SAFETY RELEASE FOR WATER SKIING TOW LINE

[75] Inventors: Edward F. Casad, St. Marys; Thomas R. Casad, Celina, both of Ohio

[73] Assignee: Ajax Machine & Welding Co., St. Marys, Ohio

[21] Appl. No.: 948,958

[22] Filed: Oct. 5, 1978

[51] Int. Cl.[2] ..... B63B 21/56

[52] U.S. Cl. ..... 114/253; 24/115 F; 114/252; 280/504; 294/83 R

[58] Field of Search ..... 114/252, 253, 249, 254; 280/504, 515; 294/83 R, 84; 24/115 F, 115 G, 115 K, 230 AP, 241 R

[56] References Cited

U.S. PATENT DOCUMENTS

| | | | |
|---|---|---|---|
| 37,681 | 2/1863 | Garmo | 114/252 |
| 1,115,807 | 11/1914 | Gellrich | 114/252 |
| 2,113,338 | 4/1938 | Wohldorf | 280/515 X |
| 2,863,200 | 12/1958 | Miller et al. | 24/230 AP |
| 3,110,331 | 11/1963 | Buchanan | 114/252 |
| 3,493,260 | 2/1970 | Smith | 294/83 R |
| 3,744,819 | 7/1973 | Cook et al. | 280/515 X |

FOREIGN PATENT DOCUMENTS

| | | | |
|---|---|---|---|
| 1062553 | 7/1959 | Fed. Rep. of Germany | 280/504 |
| 730948 | 2/1932 | France | 294/84 |
| 544581 | 3/1977 | U.S.S.R. | 114/252 |

*Primary Examiner*—Trygve M. Blix
*Assistant Examiner*—Winston H. Douglas
*Attorney, Agent, or Firm*—Gust, Irish, Jeffers & Hoffman

[57] ABSTRACT

A safety release for water skiing tow lines comprising a U-shaped body having a rearwardly facing slot therein, a mounting bracket for securing the device to a ski pylon, a bolt arm pivotally secured to the body which extends across the slot when the arm is in a vertical position so as to engage the terminal loop of the ski rope. The loop retaining bolt arm is pivotally mounted on the body and is pivotable rearwardly from a first position substantially normal to the plane of the slot opening to a second position substantially free of the slot opening. A manually operable extension is affixed to the bolt arm to move the arm in a forward direction from the second position to the first position. A lever is pivotally mounted on the body to engage the bolt arm to form a bar-like assembly which extends transversely of said opening. The lever is pivotable from a first position wherein an end thereof abuts the end of the bolt arm to releasably hold the bolt arm in its first position, to a second position wherein the lever is moved out of engagement with the bolt arm upon actuation of a trip-cord operable by the occupant in the boat.

10 Claims, 6 Drawing Figures

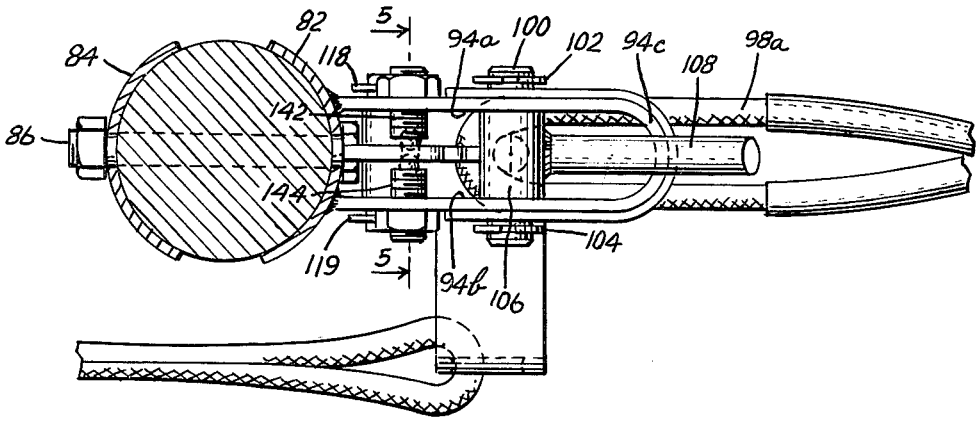
FIG.3
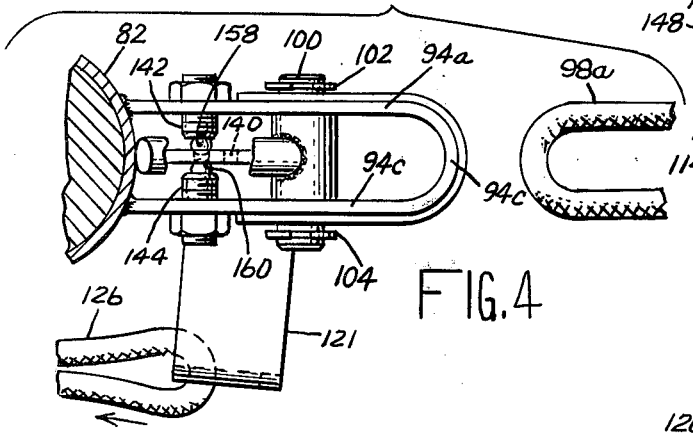
FIG.4
FIG.6
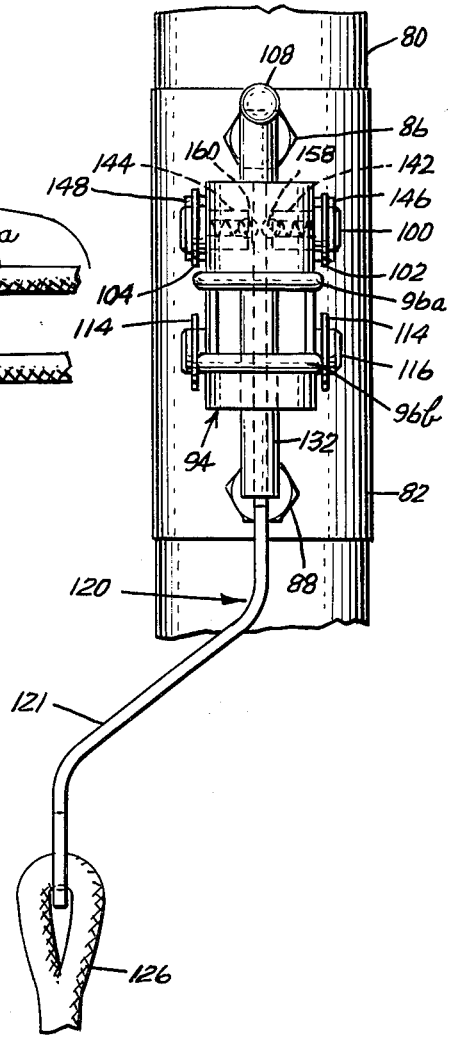
FIG.5
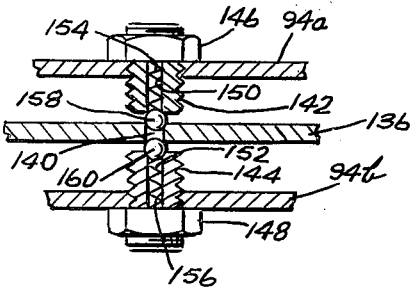

SAFETY RELEASE FOR WATER SKIING TOW LINE

BACKGROUND OF THE INVENTION

1. Field of the Invention

The present invention relates to a tow line release device and in particular to a safety release for water skiing tow lines which is adapted for quickly releasing the tow rope upon manual actuation of a trip rope from within the boat.

In many types of water skiing, it is desirable from a safety standpoint to be able to quickly release tension on the tow rope should the skier fall. In trick skiing, for example, one maneuver includes the placement of the skier's foot in the ski rope handle and he is towed without the use of his hands. Should the skier fall while in this position, he is susceptible to serious leg injuries such as pulled muscles, a twisted knee or a broken leg and may ever be dragged under water before the driver of the boat reacts and is able to stop the boat. Aside from the potential for injury, the necessity for the skier to be constantly on guard so that he is able to pull his foot out of the handle or tow strap in the case of a fall reduces his concentration on performing the maneuver.

In addition to accidents resulting because of a trick skier being unable to release his foot from the rope, many accidents occur as a result of the skier becoming entangled in the rope as it is towed from the boat even though he has released the handle. Also, in the case where two or more skiers are being towed at the same time and one skier falls, the loose rope jerks about in the water quite violently and is liable to strike one of the other skiers.

In order to avoid the type of accidents described above, it has been found advantageous to provide for quick release of the tow rope by means of a trip mechanism operated manually from within the boat. One class of prior art devices comprises a pivotally mounted finger which hooks a terminal loop in the ski rope and is retained in engaging position by means of a latch. When the latch is released, tension on the ski rope pulls the finger open thereby releasing the rope. Examples of this type of device include U.S. Pat. Nos. 3,110,331; 3,133,521; 52,385; 1,115,807; 3,205,545 and 2,721,088.

A disadvantage to this type of device is that the finger requires tension on the rope for it to open so that if the ski rope is momentarily slack, as is often the case in trick skiing, the finger will fail to open quickly. Furthermore, the open finger may present an obstacle which can catch the rope and continue to drag the skier. Although the finger in the aforementioned U.S. Pat. No. 2,721,088 is designed such that it drops by gravity to its open position when released, this renders it inherently slow to open in the case of a slack rope. In fact, the rope may even interfere with its opening.

A further example of a prior art tow rope release is shown in U.S. Pat. No. 3,583,355 which discloses a clamp for gripping the free end of the ski rope or bridle. When the release lever is pulled, the jaws of the clamp open thereby releasing the tow rope. Due to the fact that the tow rope is frictionally rather than positively engaged, it may pull loose during skiing, especially if the skier is performing meneuvers which result in a high degree of tension being applied to the rope. Furthermore, clamping of the rope in this manner is likely to result in premature rope wear.

A further drawback to pivoted finger type hitches is that the force exerted by the tow rope on the finger is in a direction which urges it towards its open position. Should the latch mechanism fail, the finger will open thereby releasing the rope and causing the skier to fall. Since this is most likely to occur when maximum tension to the rope is being applied by the skier, as in the case of slalom skiing, the sudden release of tension is more likely to cause injury.

SUMMARY OF THE INVENTION

The present invention overcomes the above-discussed disadvantages of the prior art and is an improvement over the release mechanism of prior Application Ser. No. 840,585, filed Oct. 11, 1977, now U.S. Pat. No. 4,173,196, inventors, Edward F. Casad, Thomas R. Casad and Richard E. Jones.

Specifically, the present invention is a safety release for water skiing tow ropes comprising: a body, a mounting bracket for securing the body to a towing boat, a rearwardly opening slot in the body adapted to receive a loop of rope therein, a bolt extending across the slot and closing the same so as to capture the loop of rope received in the slot, and a trip lever connected to the bolt for releasing the bolt out of the slot so that the loop of rope received therein is free to move out of the slot in an unobstructed manner. Quick release of the tow rope loop is provided by a predetermined short arcuate travel of a release arm actuated by a manual pull on the tripcord by a boat occupant. The loop of the tow rope is attached by manual actuation of a manually accessible lever protruding from the top surface of the body. The lever is pivotally attached to a shaft on the body and has a bolt arm which is pivotable from a first position substantially normal to the plane of the slot opening to a second position substantially free of the slot opening. In the second position of the bolt arm, the loop of the tow rope may be inserted in the slot opening, and by manual operation of the lever, the bolt arm caused to move from the second position to engage the loop and to move the loop to the first position. A release arm is manually pivotable about a second pivot mounted on the body abuttably to engage the free end of the bolt arm to hold it in the loop attaching position. The abuttable engagement between the bolt arm and the release arm is along a radius of the second pivot in a towing direction so that the towing force is substantially radial to the second pivot.

The loop of the towing rope is restricted by the slot to engagement with the bolt arm only, and cannot engage the release arm, so that there is no countermoment exerted by the tow line to the release force moment exerted on the release arm. Further, there is no frictional drag on the release arm by the tow rope loop to interfere with release arm movement in a release direction. Thus, a complete and quick release is obtained in response to substantially the same release force irrespective of the force exerted by the pull of the tow line on the bolt arm. This is a safety feature since release is assured with a given release force and release arm movement. Further, spring biased detent means mounted in the body cooperate with an indentation in the release arm to resiliently hold the release arm in the engaged position until released by manual actuation of the trip cord.

It is an object of the present invention to provide an improved safety release for water skiing tow ropes having a pivotable bolt which completely clears the tow rope-receiving slot upon actuation so that the tow rope is able to clear the slot in an unobstructed manner.

A further object of the present invention is to provide a safety release for water skiing tow ropes wherein the rope engaging bolt is locked both in its open and closed positions by means of an adjustable detent mechanism.

Yet another object of the present invention is to provide an improved safety release for water skiing tow ropes which will release the rope quickly and positively regardless of whether the rope is taut or slack.

A further object of this invention is to provide in the release device of the previous objects a loop positioning bolt arm which, upon manual actuation thereof will engage the loop positioned in the slot.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 3 is a top plan view of the embodiment of FIG. 1 shown in the tow rope attaching position;

FIG. 4 is a similar plan view showing the tow rope in the released position;

FIG. 5 is a section taken substantially at section line 5—5 of FIG. 3; and FIG. 6 is a rear elevational view showing the tow rope in the attached position.

DESCRIPTION OF THE PREFERRED EMBODIMENT

Figure 1:
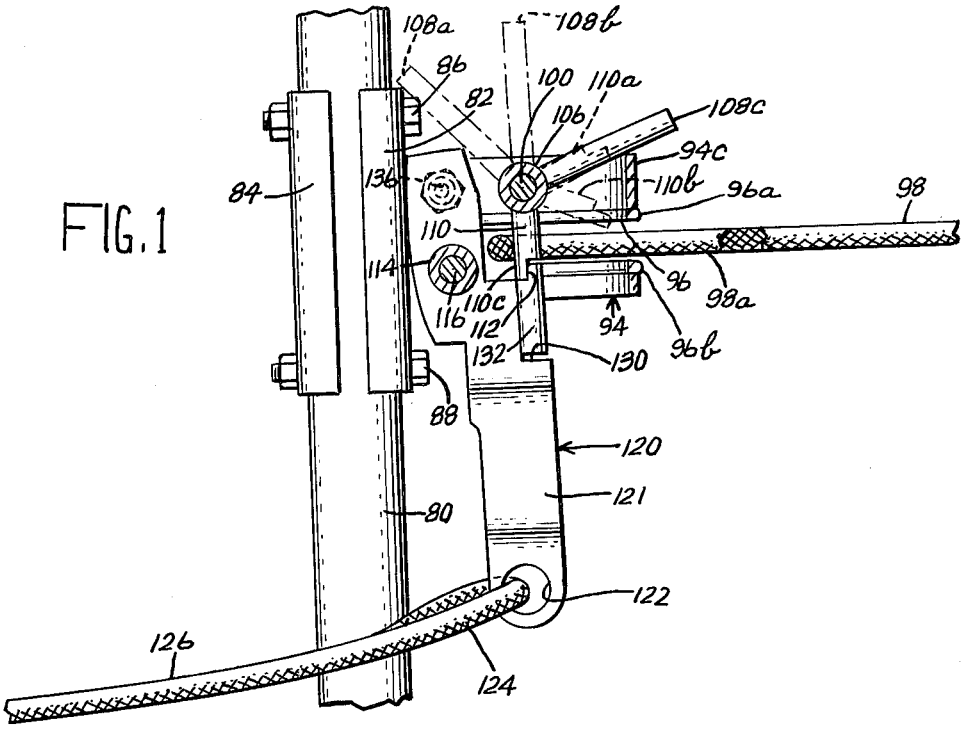
FIG. 1 is a partly sectioned view showing the release mechanism of the present invention mounted to the ski pylon of a towing boat, wherein the mechanism is in the closed position and a tensioned tow rope is engaged thereby.

Referring to the drawings, a pylon 80 is securely mounted in the towing boat and the release mechanism is secured thereto by means of two arcuately shaped clamping elements 82 and 84 and bolts 86 and 88 passing through companion aperture in the pylon 80 and elements 82 and 84. A generally U-shaped body 94 has legs 94*a* and 94*b* forwardly extending from rearward bight 94*c* and are affixed, as by welding, at the ends to bracket 82. A horizontal rearwardly opening slot 96 is formed in body 94 and is dimensioned to receive loop 98*a* of ski tow rope 98 which is attached to a conventional handle, not shown. Edge beads 96*a*, 96*b* are affixed, as by welding, to the upper and lower edges of slot 96, respectively, to present rounded edges which will prevent wear or abrasion of loop 98*a*.

A pivot pin 100 is rotatably inserted in opposed openings in the legs 94*a*, 94*b* above slot 96 and is retained therein by snap washers 102, 104 which fit into circular grooves in the end portions of pin 100. A sleeve 106 is positioned between legs 94*a*, 94*b* and rotatably receives pin 100. Sleeve 106 has a length just slightly less than the spacing between the legs 94*a*, 94*b*. A lever 108 is welded or otherwise affixed to sleeve 106 and extends upwardly between legs 94*a*, 94*b* in manually accessible position. A bolt arm 110 is affixed, as by welding, to sleeve 106 and can be pivoted about pin 100 downwardly into slot 96 as shown. A notch 112 is formed in the lower end of arm 110. Lever 108 may be swung from position 108*a*, as shown by the dashed lines in FIG. 1 to position 108*c* wherein it bears against the upper edge of bight 94*c* which serves as a stop for lever 108 in rope attachment position. An intermediate position 108*b* is also shown in dashed lines. As is apparent, movement of lever 108 will cause a corresponding movement of arm 110 to corresponding positions shown at 110*a*, 110*b* and 110*c*.

A second sleeve 114, having a length slightly less than the distance between legs 94*a* and 94*b* is disposed transversely therebetween and rotatably receives a second pivot pin 116 pivotably inserted into corresponding openings in legs 94*a*, 94*b*, pin 116 being retained in position by means of snap washers 118, 119 which fit into circular grooves in the ends of pin 116. A release arm 120 is affixed, as by welding, to sleeve 114 centrally thereof and has a downwardly depending portion 121 provided with an eye 122 in the lower end through which loop 124 of release cord 126 is passed. Lower portion 121 is offset so that cord 126 will clear pylon 80 during swinging movement thereof. As will become apparent, release of rope 98 will occur upon jerking cord 126 toward the left as viewed in FIG. 1.

Arm 120 has an elongated notch 130 on the rearward edge in which is affixed, as by welding, a cylindrical bolt 132 having a forwardly facing notch 134 formed at the upper end thereof which is registrable with notch 112 when arms 110 and 120 are in the position shown in FIG. 1. In this position, the arms 110 and 120 form a straight arm or bar assembly for receiving thereabout the attaching loop 98*a*. For reasons which will be explained, the engagement of notches 112 and 134 is along a substantially horizontal radius from pin 116. Arm 120 has an upwardly extending portion 136 (FIG. 2), the forward edge 138 thereof being gently curved to abut the rearward facing surface of bracket 82 as a stop when the arm is swung to the position shown in FIG. 2.

Arm portion 136 is provided with a detent hole 140, FIG. 5, which is engaged by detents which include a pair of set screws 142, 144 threaded into legs 94*a*, 94*b*, respectively, and retained in an adjusted position by means of lock nuts 146 and 148, respectively. Screws 142 and 144 have inwardly facing spring sockets 150 and 152, for receiving springs 154 and 156 and detent balls 158 and 160, respectively. Balls 158 and 160 engage hole 140 when arm 120 is in the loop-attaching position shown in FIG. 1. Screws 142 and 144 may be adjusted to pre-load springs 150 and 152.

In operation, the loop 98*a* is inserted in slot 96. The lever 108 is in position 108*a* and arm 110 is in position 110*a* so that slot 96 is unobstructed. Arm 108*a* is then manually moved rearwardly, arm 110 being pivoted downwardly into slot 96 fitting inside of or engaging the forward end of loop 98*a* and positioning loop 98*a* in the attachment position shown by the solid lines in FIG. 1. This is an important feature of this invention since loop 98*a* may be just partially inserted in slot 96 and the rearward pivotable movement of lever 108 will automatically position loop 98*a* to the fully inserted attachment position. When lever 108 is in position 108*c*, which is determined by engagement with the upper edge of bight 94*c*, arm 110 assumes a substantially vertical position.

Figure 2:
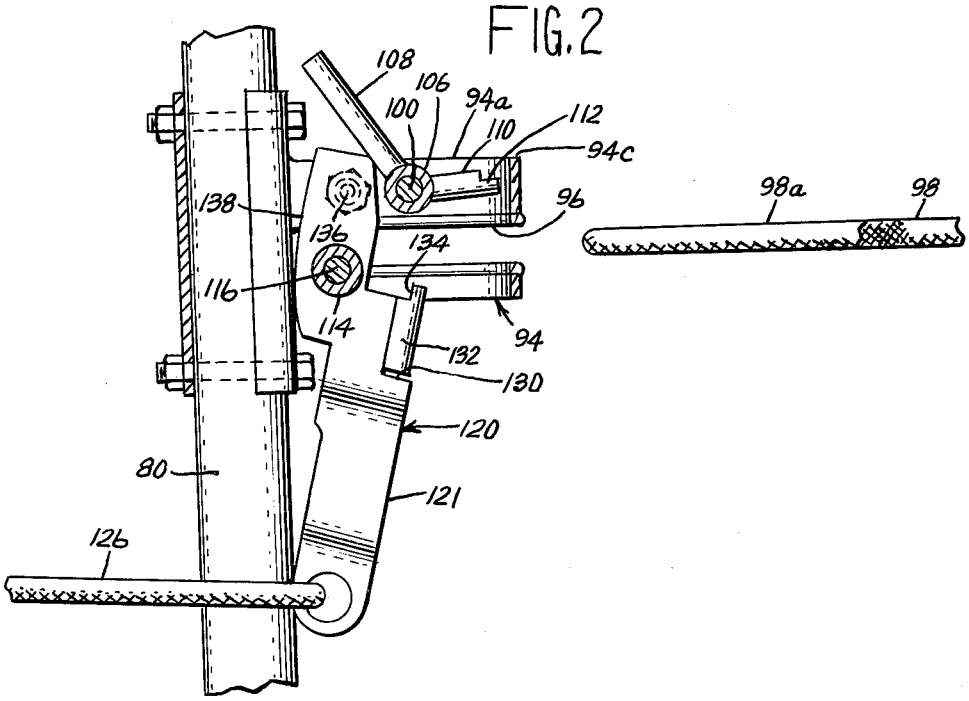
FIG. 2 is a similar view shown in the tow rope releasing position.

During positioning of loop 98*a*, arm 120 is in the position shown in FIG. 2 wherein bolt 132 is below slot 96 providing clearance for the vertical positioning of arm 110, after which arm 120 is rocked counterclockwise about pin 116 until balls 158 and 160 engage detent hole 140 under the force of springs 150 and 152, respectively, thus releasably and resiliently holding arm 120 in the loop-attaching position wherein notches 112 and 134 engage for holding arm 110 in position. Positive limits of rocking movement of arm 120 are provided by the abutment of edge 138 against bracket 82 at both the lower (FIG. 2) and upper portions thereof against bracket 82. In the released position the lower portion of edge 138 abuts bracket 82 and in the loop-attaching or closed position the upper portion engages bracket 82. In the closed position, a towing force on rope 98 forcefully engages the abutting surfaces of notches 112, 134 along a substantially horizontal radius of pivot pin 116, this radius being substantially normal to these abutting surfaces. Thus, the towing force exerts insufficient releasing moment force on release arm 120 to rock or rotate arm 120 to its release position. However, should the skier be in jeopardy, the boat occupant can jerk release cord 126 toward the left as shown in FIG. 1 rotating arm 120 in a clockwise direction against the detent force of balls 158 and 160 moving bolt 132 clear of slot 96 wherein arm 110 can freely pivot in a counterclockwise direction, as viewed in FIGS. 1 and 2. This completely frees slot 96 and permits ready withdrawal of loop 98*a* therefrom thus preventing the skier from being dragged in the water. It will be appreciated that the release is accomplished by the first portion of arcuate movement of arm 120 of approximately 10° in the disclosed embodiment. Also, arm 120 is not in direct contact with loop 98*a* which can interfere with a quick and positive release of loop 98*a*.

The above described structural components are preferably made of high strength stainless steel which will resist corrosion and will provide a durable, strong construction.

While there have been described above the principles of this invention in connection with specific apparatus, it is to be clearly understood that this description is made only by way of example and not as a limitation to the scope of the invention.

What is claimed is:

1. A safety release for water skiing tow ropes actuable by a tow boat occupant comprising:

a body having front and rear portions;

first means for removably attaching said body to a towing boat;

a horizontally disposed slot formed in and opening through the front portion of said body and adapted to slidably receive a loop of rope therein, the loop being slidable in said slot between a rearward slot position to a forward loop-attaching position;

second means for engaging and positioning the loop in the slot;

said second means being freely movable in a rearward direction out of said slot under a pulling force of said rope;

third means pivotably movable into engagement with said second means for holding said second means in said loop-attaching position and for manually releasing said engagement to permit said second means to move rearwardly, said engagement being substantially in a horizontal plane including the pivot axis of the third means, locating means including said slot for positioning said loop of rope in or above the plane of said engagement; and fourth means for yieldably retaining said third means in engagement with said second means.

2. The apparatus of claim 1 wherein said second means comprises a bolt-arm pivotally mounted on said body with the end thereof pivotable rearwardly from a first forward position wherein said arm is disposed out of said slot opening to a second position wherein said arm is disposed across said slot opening substantially normal thereto;

a manually accessible lever being affixed to said bolt arm and manually operable to move said bolt arm in a forward direction from said second position to said first position; and a stop member on said body and engageable with said lever to limit lever and arm movement in a forward direction to said first position.

3. The apparatus of claim 2 wherein said third means comprises a release arm pivotally mounted on said body with the end thereof pivotable rearwardly from a first position wherein the end of said release arm is in horizontal abutting engagement with the end of said bolt arm to releasably hold said bolt arm in said loop-attaching position, said release arm being pivotable to a second position wherein the end thereof is forwardly moved out of engagement with said bolt arm to permit movement of said bolt arm out of said slot to the first position thereof; and said third means further comprising a release lever affixed at one end to said release arm.

4. The apparatus of claim 3 wherein said fourth means comprises an adjustable spring loaded detent attached to said body and engageable with an indentation in said release arm when said release arm is in said first position to releasably hold said release lever and release arm in said first position.

5. The apparatus of claim 3 wherein said release arm disengages said second means during the first approximately 10° of arcuate movement in an arcuate path, thereby providing a quick release of said second means.

6. The apparatus of claim 3 wherein said release arm in the second position being disposed outside said slot opening.

7. A safety release mechanism for a tow rope comprising:

a U-shaped body having spaced legs forwardly extending from a rearward bight portion;

said legs and bight portion having a rearwardly opening horizontal slot formed therein, said legs having respective upper portions above said slot and respective lower portions below said slot, said slot being adapted to receive the loop of a tow rope;

a bolt arm pivotally attached at one end between said upper portions above said slot and pivotable downwardly between said legs to sweep said slot in a forward direction to a substantially vertical position, said bolt arm engageable with the tow rope loop in a rearward position in said slot to move said loop in said slot forwardly as said arm sweeps forwardly through said slot;

a manually accessible lever affixed at one end to said one end of said arm, said lever extending between said legs above said body whereby manipulation of said lever will pivot said bolt arm in said forwardly direction, said lever abuttable against the top edge of said bight portion to define a lever stop position wherein said arm is in said substantially vertical position;

a release arm pivotally attached at one end to said body between said legs about a pivot axis substantially horizontally aligned with said other end of said bolt arm when said bolt arm is in said substantially vertical position, said release arm in a first position having a portion abuttably engageable with said other end of said bolt arm to retain said bolt arm in said vertical position against the pulling force of said tow line, said release arm being pivotable to release said bolt arm to pivot freely in a rearward direction releasing said tow line;

the other end of said bolt arm being disposed between the lower portions of said body when said bolt arm is in said substantially vertical position, the slot positioning the loop of the tow line in engagement with said bolt arm.

8. The apparatus of claim 7 including detent means mounted on said body and in releasable resilient engagement with said release arm for resiliently and releasably retaining said release arm in said first position, means attached to said release arm for manual pivoting of said release arm from said first position to release said bolt arm.

9. The apparatus of claim 7 wherein said release arm releases said bolt arm in the first 10° of pivoting of said release arm.

10. The device of claim 7 wherein the axis of said bolt arm lies in a horizontal plane and extends substantially perpendicular to said legs, said bolt arm and said manual lever defining an obtuse angle therebetween which faces rearwardly, the pivot axis of said release arm lying in a horizontal plane and extending perpendicular to said legs, and the pivot axis of said release arm being beneath the plane of the axis of said bolt arm.

* * * * *